US009772091B2

(12) United States Patent
Lin et al.

(10) Patent No.: US 9,772,091 B2
(45) Date of Patent: Sep. 26, 2017

(54) LENS AND OMNIDIRECTIONAL ILLUMINATION DEVICE INCLUDING THE LENS

(71) Applicant: OSRAM GmbH, Munich (DE)

(72) Inventors: XueQin Lin, Shanghai (CN); YingJun Cheng, Shanghai (CN)

(73) Assignee: OSRAM GmbH (DE)

( * ) Notice: Subject to any disclaimer, the term of this patent is extended or adjusted under 35 U.S.C. 154(b) by 526 days.

(21) Appl. No.: 14/375,158

(22) PCT Filed: Jan. 28, 2013

(86) PCT No.: PCT/EP2013/051588
§ 371 (c)(1),
(2) Date: Jul. 29, 2014

(87) PCT Pub. No.: WO2013/113661
PCT Pub. Date: Aug. 8, 2013

(65) Prior Publication Data

US 2015/0003075 A1 Jan. 1, 2015

(30) Foreign Application Priority Data

Jan. 31, 2012 (CN) ..... 2012 1 0021809

(51) Int. Cl.
*F21V 5/00* (2015.01)
*F21V 13/04* (2006.01)
(Continued)

(52) U.S. Cl.
CPC ..... *F21V 13/04* (2013.01); *F21V 5/04* (2013.01); *F21V 7/0091* (2013.01); *F21K 9/232* (2016.08);
(Continued)

(58) Field of Classification Search
CPC ..... F21V 13/04; F21V 5/04
See application file for complete search history.

(56) References Cited

U.S. PATENT DOCUMENTS

2002/0114170 A1 8/2002 Chen et al.
2011/0148270 A1 6/2011 Bhairi
2011/0235333 A1* 9/2011 Koike ..... F21V 5/04 362/277

FOREIGN PATENT DOCUMENTS

CN 101900302 A 12/2010
CN 201779598 U 3/2011
(Continued)

OTHER PUBLICATIONS

International Search Report dated Apr. 3, 2013.

*Primary Examiner* — Evan Dzierzynski
(74) *Attorney, Agent, or Firm* — Hayes Soloway PC

(57) ABSTRACT

Various embodiments relate to a lens for omnidirectional illumination being rotationally symmetrical and including a light incident surface, a first refractive surface, a first reflective surface, a second refractive surface, and a third refractive surface. A first portion of light which passed through the light incident surface is refracted by the first refractive surface to produce first emergent light. A second portion of the light which passed through the light incident surface is reflected by the first reflective surface to the second refractive surface, and then is refracted by the second refractive surface to produce second emergent light. A third portion of the light which passed through the light incident surface is refracted by the third light refractive surface to produce third emergent light, the first emergent light, the second emergent light and the third emergent light jointly achieved omnidirectional illumination.

16 Claims, 8 Drawing Sheets

(51) Int. Cl.

| | |
|---|---|
| ***F21V 5/04*** | (2006.01) |
| ***F21V 7/00*** | (2006.01) |
| *F21V 29/77* | (2015.01) |
| *F21K 9/232* | (2016.01) |
| *F21K 9/60* | (2016.01) |
| *F21Y 115/10* | (2016.01) |

(52) U.S. Cl.
CPC ..... *F21K 9/60* (2016.08); *F21V 29/773* (2015.01); *F21Y 2115/10* (2016.08)

(56) References Cited

FOREIGN PATENT DOCUMENTS

| | | | |
|---|---|---|---|
| EP | 2180234 | A1 | 4/2010 |
| EP | 2214046 | A1 | 8/2010 |
| EP | 2367045 | A1 | 9/2011 |
| WO | 2009059125 | A1 | 5/2009 |

* cited by examiner

LENS AND OMNIDIRECTIONAL ILLUMINATION DEVICE INCLUDING THE LENS

RELATED APPLICATIONS

The present application is a national stage entry according to 35 U.S.C. §371 of PCT application No.: PCT/ep2013/051588 filed on Jan. 28, 2013, which claims priority from Chinese application No.: 201210021809.3 filed on Jan. 31, 2012, and is incorporated herein by reference in its entirety.

TECHNICAL FIELD

Various embodiments relate to a lens and an omnidirectional illumination device including the lens.

BACKGROUND

With the advantages of long life, energy saving, environmental friendly and shake-resistant, the LED light sources can be applied in a wide area. With the development of manufacture technology, the cost of the LEDs becomes lower and lower, and the optical efficiency is increased a lot. It is a trend that solid-state lighting (SSL) replaces the traditional lighting devices.

The US Energy Star criteria have certain requirements for omnidirectional SSL replacement lamps (shown in FIG. 1). Within 0° to 135° zone, luminous intensity at any angle shall not differ from the mean intensity for the entire 0° to 135° zone by more than 20%. Flux within 135° to 180° zone shall occupy at least 5% of the total flux. Measurement results should be the same in vertical plane 45° and 90° from the initial plane. Most of the LEDs' intensity distribution is lambertian rather than uniform, so secondary optical design is indispensable. For SSL replacement lamps, in order to meet those requirements, it is essential to design optical components to redistribute light.

In the related art, there are many solutions to get light source redistribution for LED lamps. The first solution is optimizing LEDs' array, and the second solution is using reflector to redistribute light.

Patent with the number of WO2009/059125A1 discloses an optical assembly including a single LED lamp and a rotationally symmetrical reflective light transformer providing an omnidirectional pattern with a pre-calculated intensity distribution.

Patent with the number of EP2180234A1 discloses an omnidirectional light bulb containing a transparent body member and a contact member at an end of the body member that could be screwed into a conventional light bulb socket for establishing electrical connections. The light bulb also contains at least a disc and a supporting pole. A number of LEDs are back-to-back configured along the circumference of each disc, so as to realize the omnidirectional illumination.

Patent with the number of US2002/0114170A1 discloses an incandescent light source replaced with omnidirectional distribution. A light guide receives and guides light output from the light source. The light guide further extends out from the light source. A reflector is positioned in the light guide and reflects the light guided through the light guide to provide appropriate edge illumination.

Among all of the above solutions, no solution is proposed for achieving omnidirectional illumination through the design of a lens.

SUMMARY

Various embodiments provide a lens for omnidirectional illumination and an omnidirectional illumination device including the lens, which can eliminate the defects of the various solutions in the related art and have the advantages of low manufacturing cost, simple manufacturing process, uniform light distribution, and omnidirectional illumination.

According to a first aspect of the present disclosure, a lens for omnidirectional illumination is provided, characterized in that, the lens is rotationally symmetrical and includes a light incident surface, a first refractive surface, a first reflective surface, a second refractive surface and a third refractive surface, to be rotationally symmetrical, respectively, a first portion of light which passed through the light incident surface is refracted by the first refractive surface to produce first emergent light, a second portion of the light which passed through the light incident surface is reflected by the first reflective surface to the second refractive surface, and then is refracted by the second refractive surface to produce second emergent light, and a third portion of the light which passed through the light incident surface is refracted by the third light refractive surface to produce third emergent light, the first emergent light, the second emergent light and the third emergent light jointly achieved omnidirectional illumination.

According to the present disclosure, omnidirectional illumination is provided by designing the lens to have a plurality of refractive surfaces and reflective surfaces. The first emergent light for forward illumination is provided through the first refractive surface, the third emergent light which is achieved through the third light refractive surface achieves backward illumination which is different from the forward illumination, the second emergent light for backward illumination is provided by the cooperation of the first reflective surface and the second refractive surface, to supplement the third emergent light, and thereby, omnidirectional illumination is provided.

According to various embodiments, the lens includes a bottom surface, a top surface, and side surface connecting the top surface with the bottom surface, the bottom surface is partially curved to form the light incident surface for a light source, the top surface includes the first refractive surface and the first reflective surface, and the side surface include the second refractive surface and the third light refractive surface. Forward illumination of the top region is achieved using the first refractive surface, inclinedly downward illumination in the side direction is achieved using the third light refractive surface, the deflection of the direction of the light rays is achieved using the second refractive surface and the first reflective surface, such that the light rays turn downwards for illumination, which achieves backward illumination.

Preferably, the top surface includes the first refractive surface in the center, and the first reflective surface at the edge and surrounding the first refractive surface. Thus, forward illumination within the center of the top region is achieved using the first refractive surface. Further, it is more convenient for the first reflective surface to match with the second refractive surface in the side direction.

Preferably, the side surfaces include the second refractive surface connected with the first reflective surface, and the third refractive surface connected with the bottom surface. This design optimizes the matching of the first reflective surface and the second refractive surface, and the refraction of the third portion of the light going through the light incident surface by the third light refractive surface.

Preferably, the second refractive surface has a profile inclined with respect to and extending towards, starting from the first reflective surface, a symmetrical axis of the lens so as to form an acute angle with the first reflective surface. The design of the second refractive surface relies on the design of the first reflective surface. The numerical value of the inclination angle of the second refractive surface with respect to the first reflective surface and the degree at which the second refractive surface inclinedly extends towards the symmetrical axis of the lens rely on the size, position and specific profile of the first reflective surface. The general principle is that the emergence range of the second emergent light shall comply with the expected light distribution.

Preferably, the second refractive surface inclinedly extends towards the symmetrical axis of the lens, in such an extent that all of light rays from the first reflective surface emerge from the second refractive surface. Therefore, the second portion of the light going through the light incident surface is converted to the second emergent light at high efficiency.

According to various embodiments, the bottom surface includes the concave light incident surface in the center, and a planar supporting base surface at the edge and surrounding the light incident surface. In this way, the concave light incident surface provides an accommodation cavity for a light source, and the planar supporting base surface provides convenience for arranging a lens.

Preferably, the third light refractive surface is connected with the supporting base surface and has a profile inclined with respect to and extending towards, starting from the supporting base, the symmetrical axis of the lens so as form an acute angle with the supporting base surface, so as to try to achieve light projection of the third emergent light as backward as possible in the side direction.

Preferably, the third light refractive surface extends towards the symmetrical axis of the lens to a boundary of the second portion of the light incident upon the first reflective surface, which achieves clear demarcation between the second portion of the light and the third portion of the light, and try to achieve light projection of the third emergent light as backward as possible in the side direction.

Preferably, the first reflective surface is a planar surface or an inclined surface. The first reflective surface is designed according to the expected second emergent light.

Preferably, the first refractive surface, the second refractive surface and the third light refractive surface are respectively a spline curve in a cross section.

Preferably, the light incident surface is an arc surface in a cross section, and more preferably, the light incident surface is a semicircular surface in a cross section, which, thereby, tries not to change the distribution of the light from the light source.

According to a second aspect of the present disclosure, an omnidirectional illumination device is provided, characterized by including a directional light source and a lens having the above features, so as to omnidirectionally distribute the light from the directional light source by using the lens.

The lens and the omnidirectional illumination device according to the present disclosure have the advantages of low manufacturing cost, simple manufacturing process, uniform light distribution, and omnidirectional illumination.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
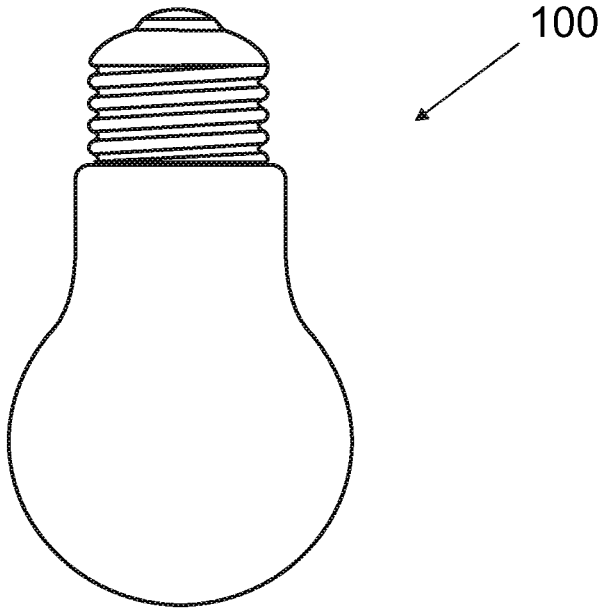
FIG. 1 is an SSL replacement lamp in the related art.
Figure 2:
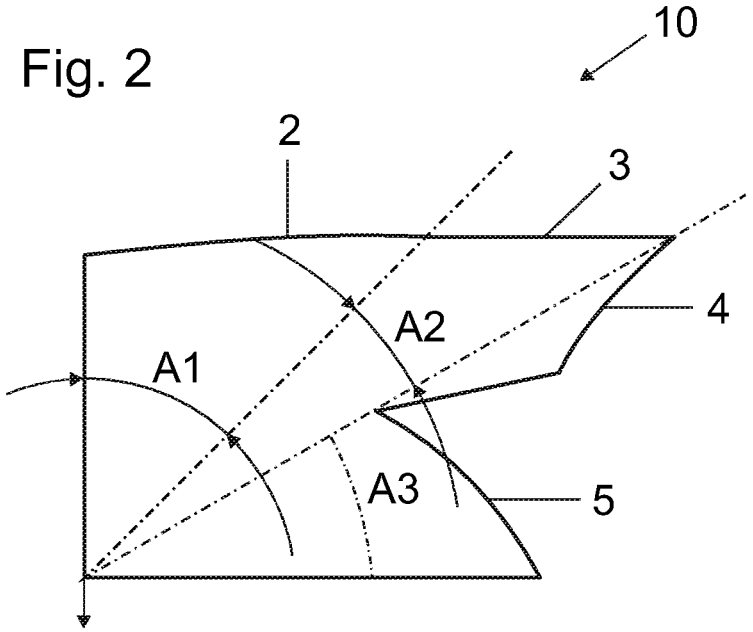
FIG. 2 is a schematic diagram of a rotationally symmetrical graph which is rotated so as to form rotationally symmetrical lens according to the first embodiment of the present disclosure.

FIG. 2 is a schematic diagram of a rotationally symmetrical graph which is rotated so as to form rotationally symmetrical lens according to the first embodiment of the present disclosure. The lens 10 according to the present disclosure is designed to be rotationally symmetrical. Thus, FIG. 2 illustrates a rotationally symmetrical graph which is rotated so as to form rotationally symmetrical lens, viz. illustrates a diagram of a cross-sectional profile of the lens in one quadrant. The rotationally symmetrical graphic comprises a top edge, a bottom edge and side edges connecting the top edge with the bottom edge. After being rotated, the top edge, the bottom edge and side edges form a top surface of the lens 10, a bottom surface of the lens 10, and side surfaces of the lens 10 connecting the top surface with the bottom surface.

Figure 3:
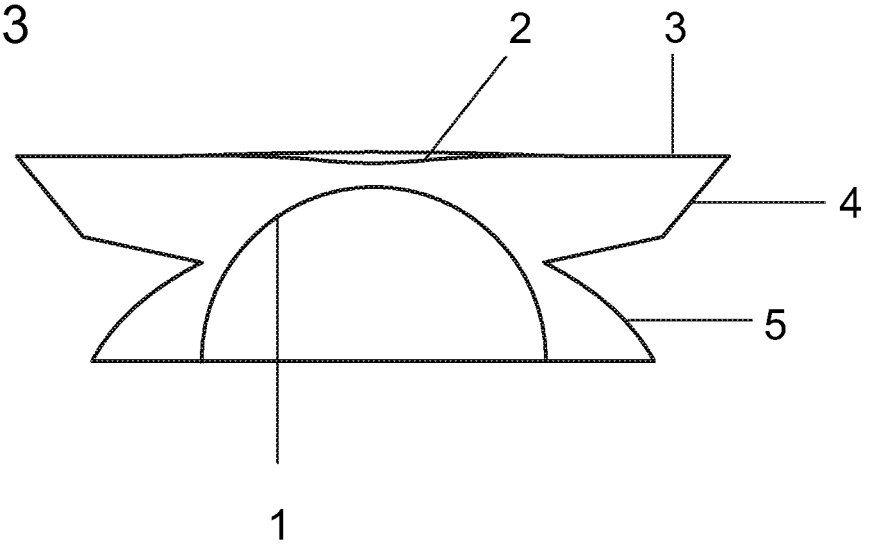
FIG. 3 is a diagram of a complete sectional profile according to the first embodiment of the lens of the present disclosure.

FIG. 3 is a diagram of a complete sectional profile according to the first embodiment of the lens 10 of the present disclosure. The diagram of a complete sectional profile of the lens 10 obtained after rotation can be seen from the figure. In conjunction with FIG. 2 and FIG. 3, it can be seen that, in the present embodiment, the top surface comprises, from the center to the edge, a first refractive surface 2 and a first reflective surface 3, and side surfaces comprise a second refractive surface 4 and a third refractive surface 5. The second refractive surface 4 is connected with the first reflective surface 3, and the third light refractive surface 5 is connected with the bottom surface. The second refractive surface 4 and the third light refractive surface 5 can be connected directly or can be connected by a surface.

As can be seen from FIG. 2, the light going through the light incident surface 1 is divided into three portions, viz. a first portion A1, a second portion A2, and a third portion A3. The first portion A1 corresponds to the first refractive surface 2, and the first refractive surface 2 is used for refracting the first portion A1. The second portion A2 corresponds to the first reflective surface 3 and the second refractive surface 4, and the second portion A2 of the light going through the light incident surface 1 emits to the first reflective surface 3, and is reflected by the first reflective surface 3 to the second refractive surface 4, and then emerges after being refracted by the second refractive surface 4. The third portion A3 corresponds to the third light refractive surface 5, and the third light refractive surface 5 is used for refracting the third portion A3.

As can be seen from FIG. 3, the bottom surface of the lens 10 is partially curved to form a light incident surface 1 for a light source. The bottom surface comprises a concave light incident surface 1 in the center, and a planar supporting base surface at the edge and surrounding the light incident surface 1. The light incident surface 1 forms an accommodation cavity for a light source. The light going through the light incident surface 1 produces three portions of light as mentioned above, viz. a first portion A1, a second portion A2, and a third portion A3. In order to try not to change the direction of the light from the light source, the light incident surface is an arc surface in a cross section. In the present embodiment, the light incident surface is a semicircular surface in a cross section.

Figure 4:
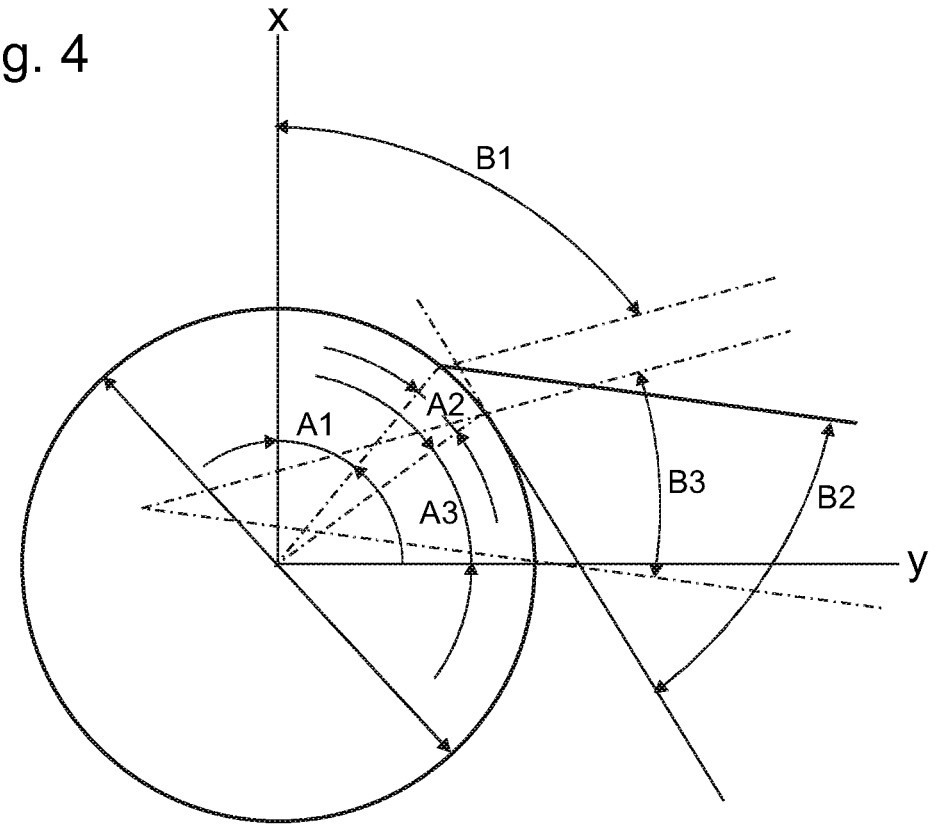
FIG. 4 is a schematic diagram of emergent light according to the first embodiment of the lens of the present disclosure.

FIG. 4 is a schematic diagram of emergent light according to the first embodiment of the lens of the present disclosure. As can be seen from the figure, the emergent light includes three portions, viz. first emergent light B1, second emergent light B2, and third emergent light B3. The three portions of emergent light B1, B2 and B3 respectively correspond to the three portions of the light going through the light incident surface 1, viz. the first portion A1, the second portion A2, and the third portion A3. The first portion A1 produces the first emergent light B1, and the first emergent light B1 is forward illumination, that is illumination on the top portion in the first quadrant. The second portion A2 produces the second emergent light B2, and second emergent light B2 is backward illumination partially covering the first quadrant and the fourth quadrant. The third portion A3 produces the third emergent light B3, and the third emergent light B3 is backward illumination at the sides. FIG. 4 merely illustrates a schematic diagram of emergent light in one quadrant. As the lens according to the present disclosure is rotationally symmetrical, better illumination is finally achieved through overlapping of emergent light in a circumferential direction of the lens.

In conjunction with FIG. 2 and FIG. 4, it can be seen that, in order to achieve the above emergent light, the second refractive surface 4 has inclined profile, starting from the first reflective surface 3 and extending towards the symmetrical axis of the lens, so as to form an acute angle with the first reflective surface 3. According to different requirements of light distribution, different first reflective surfaces 3 and different second refractive surfaces 4 can be designed, such that all of the light rays from the first reflective surfaces 3 emerge from the second refractive surface 4. According to the present embodiment, the first reflective surface 3 is designed to be planar. The first refractive surface 2 and the third light refractive surface 5 are respectively a spline curve in a cross section.

According to the second embodiment of the lens of the present disclosure which is not shown, the first reflective surface 3 is designed to be an inclined surface.

Likewise, the third light refractive surface 5 is connected with a planar portion of the bottom surface, viz. a supporting base surface, and has an inclined profile, starting from the supporting base surface and extending towards the symmetrical axis of the lens, so as to form an acute angle with the supporting base surface. The third light refractive surface 5 extends to a boundary of the second portion A2 of the light incident upon the first reflective surface 3.

Figure 5:
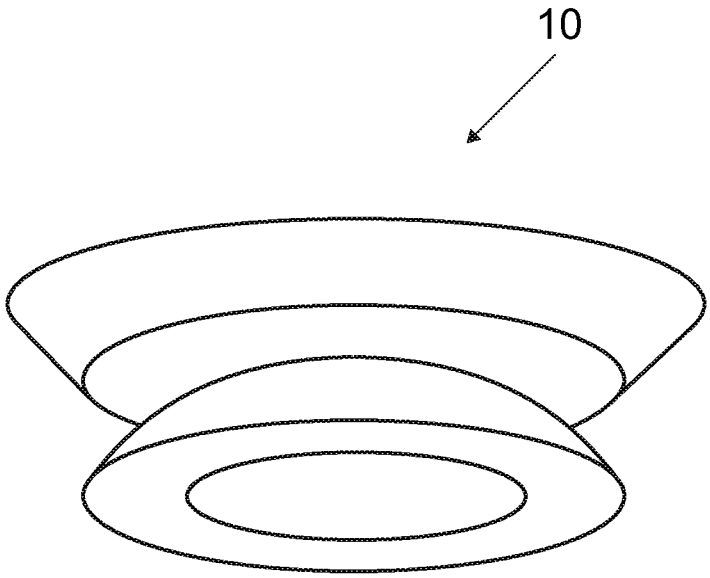
FIG. 5 is a first 3D view according to the first embodiment of the lens of the present disclosure.
Figure 6:
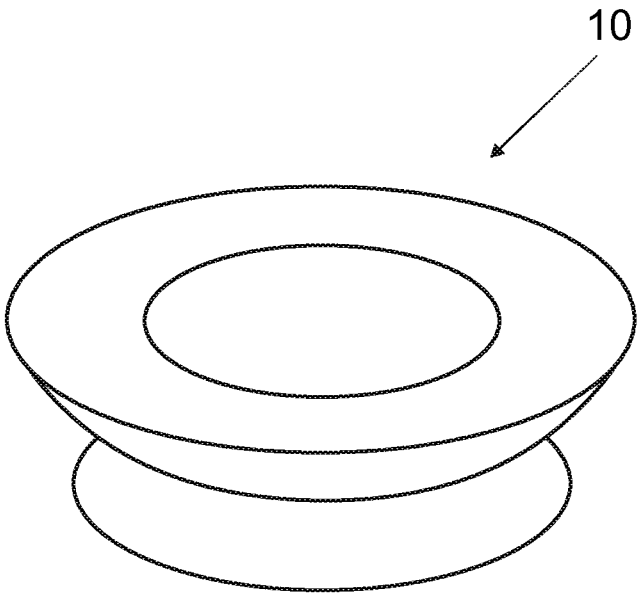
FIG. 6 is a second 3D view according to the first embodiment of the lens of the present disclosure.

FIG. 5 and FIG. 6 are respectively first and second 3D views according to the first embodiment of the lens of the present disclosure. The lens 10 according to the present disclosure comprises two portions, viz. a first portion and a second portion. The first portion is a first spherical crown formed by the rotation of the third light refractive surface 5 and the bottom surface, and the second portion is a second spherical crown formed by the rotation of the first refractive surface 2, the first reflective surface 3 and the second refractive surface 4.

Figure 7:
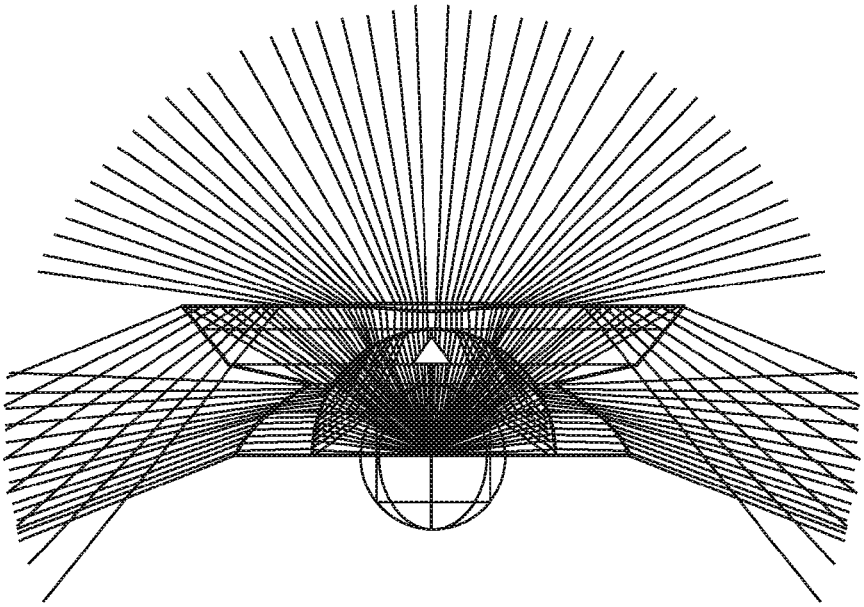
FIG. 7 is a first light distribution schematic diagram of the emergent light according to the first embodiment of the lens of the present disclosure.
Figure 8:
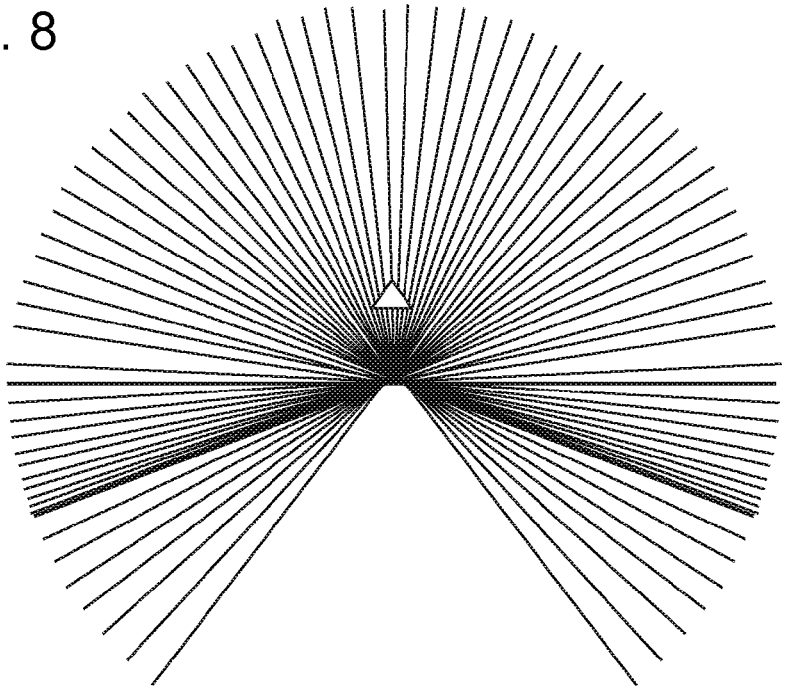
FIG. 8 is a second light distribution schematic diagram of the emergent light according to the first embodiment of the lens of the present disclosure.

FIG. 7 and FIG. 8 are first and second light distribution schematic diagrams of the emergent light according to the first embodiment of the lens of the present disclosure. As can be seen from the figures, the lens 10 according to the present disclosure substantially achieves omnidirectional illumination.

Figure 9:
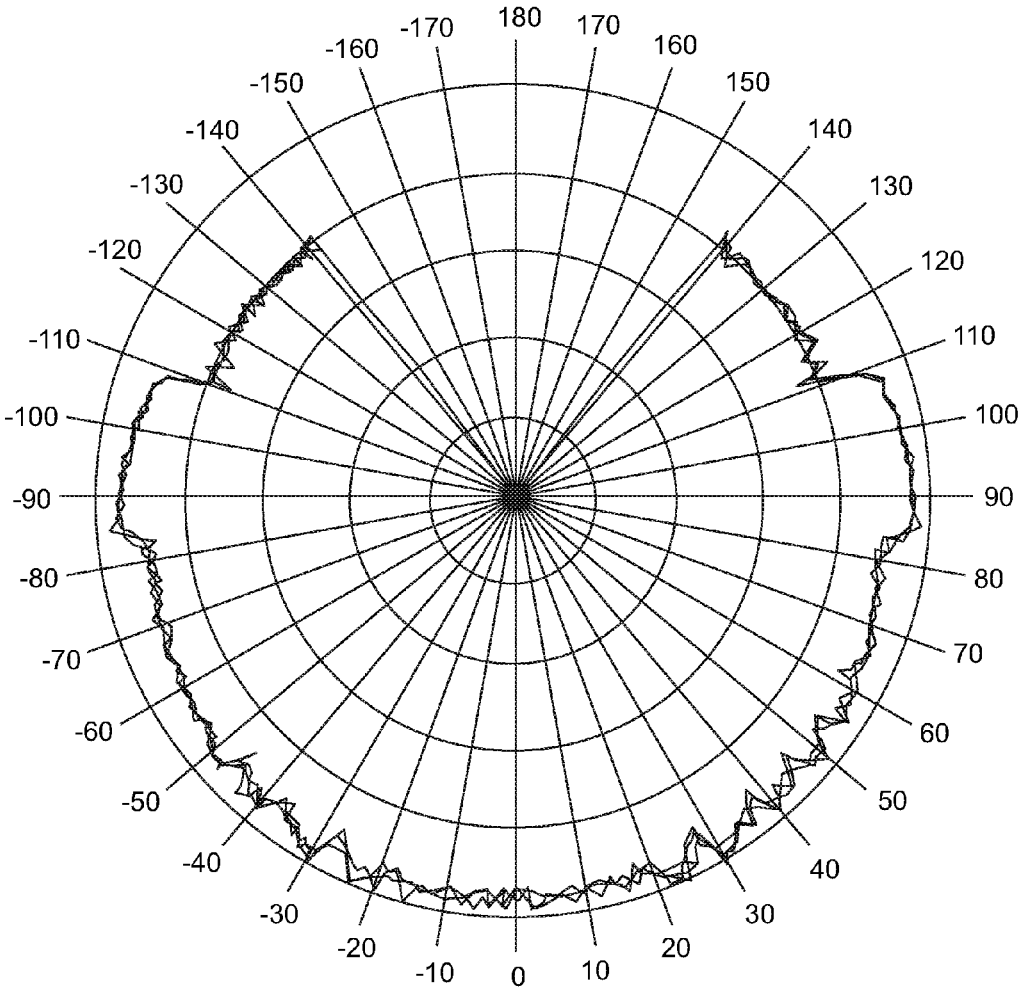
FIG. 9 is a light distribution curve of the emergent light according to the first embodiment of the lens of the present disclosure.

FIG. 9 is a light distribution diagram of the emergent light according to the first embodiment of the lens of the present disclosure, wherein the luminous intensity is uniform in the range of −140° to 140°.

Figure 10:
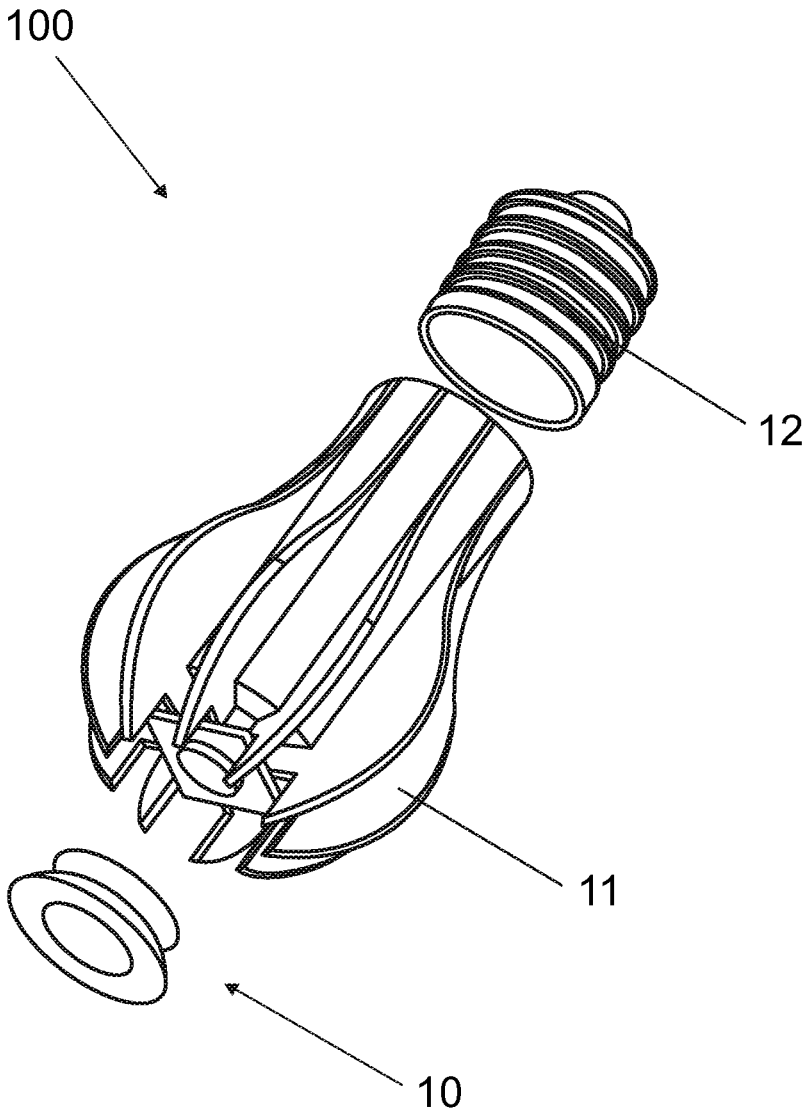
FIGS. 10-12 are schematic diagrams according to the first embodiment of the omnidirectional illumination device of the present disclosure.
Figure 11:
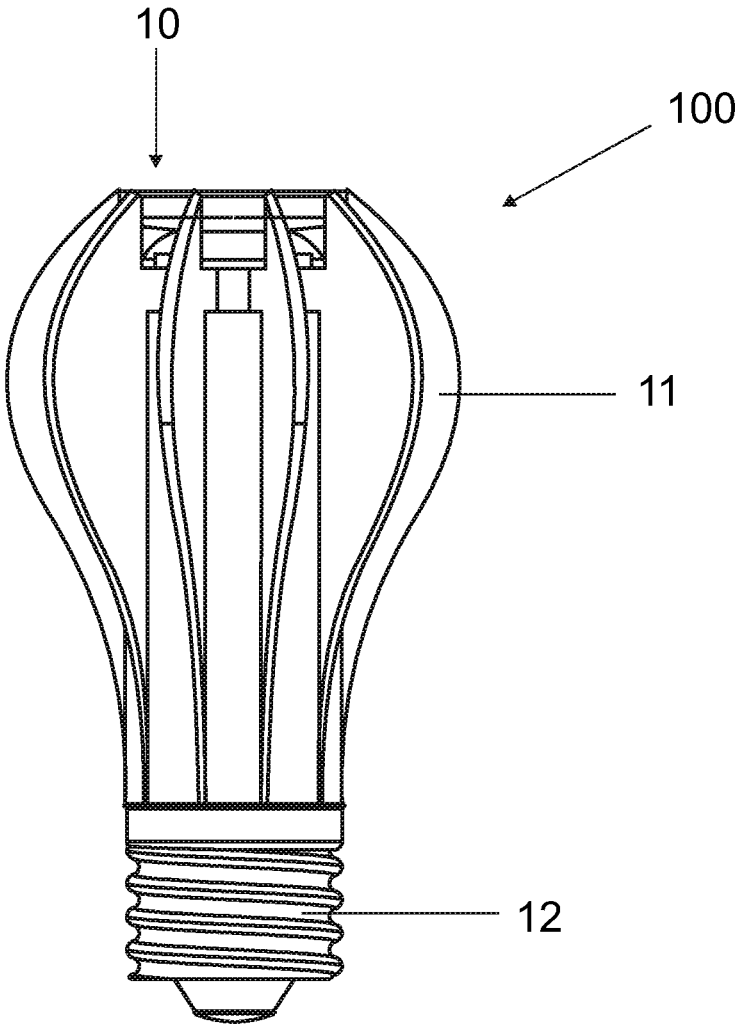
Figure 12:
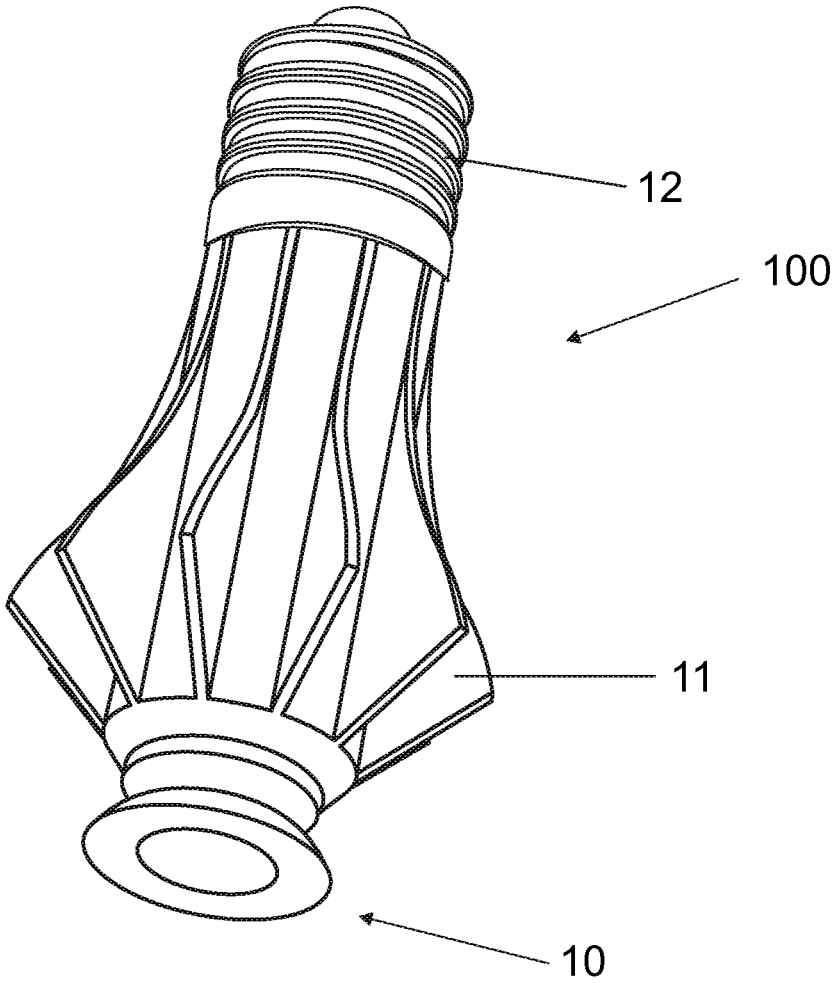

FIGS. 10-12 are schematic diagrams according to the first embodiment of the omnidirectional illumination device 100 of the present disclosure. The omnidirectional illumination device 100 is a retrofit lamp comprising a lamp housing body supporting an LED light source and an electrical connecting portion 12, an external surface of the lamp housing body being provided with heat dissipating fins 11. The lens 10 accommodates the LED light source, and the lens 10 can be designed to have different sizes according to the size of the LED light source and occupies small space, which, thereby, leaves large space for arranging the heat dissipating fins 11.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

10 lens
100 omnidirectional illumination device
1 light incident surface
2 first refractive surface
3 first reflective surface
4 second refractive surface
5 third light refractive surface
A1 first portion
A2 second portion
A3 third portion
B1 first emergent light B2 second emergent light B3 third emergent light

The invention claimed is:

1. A lens for omnidirectional illumination, the lens being rotationally symmetrical, the lens comprising:

a light incident surface, a first refractive surface, a first reflective surface, a second refractive surface and a third refractive surface, each being rotationally symmetrical, respectively, wherein a first portion of light which passes through the light incident surface is refracted by the first refractive surface to produce first emergent light, a second portion of the light which passes through the light incident surface is reflected by the first reflective surface to the second refractive surface, and then is refracted by the second refractive surface to produce second emergent light, and a third portion of the light which passes through the light incident surface directly to the third light refractive surface is refracted by the third light refractive surface to produce third emergent light, wherein the first emergent light, the second emergent light and the third emergent light jointly achieve omnidirectional illumination.

2. The lens according to claim 1, wherein the lens comprises a bottom surface, a top surface, and side surface connecting the top surface with the bottom surface, the bottom surface is partially curved to form the light incident surface for a light source, the top surface comprises the first refractive surface and the first reflective surface, and the side surface comprises the second refractive surface and the third light refractive surface.

3. The lens according to claim 2, wherein the top surface comprises the first refractive surface in the center, and the first reflective surface at the edge surrounding the first refractive surface.

4. The lens according to claim 3, wherein the side surfaces comprise the second refractive surface connected with the first reflective surface, and the third refractive surface connected with the bottom surface.

5. The lens according to claim 4, wherein the second refractive surface has a profile inclined with respect to and extending towards, starting from the first reflective surface, a symmetrical axis of the lens so as to form an acute angle with the first reflective surface.

6. The lens according to claim 5, wherein the second refractive surface inclinedly extends towards the symmetrical axis of the lens, in such an extent that all of light rays from the first reflective surface emerge from the second refractive surface.

7. The lens according to claim 4, wherein the bottom surface comprises the concave light incident surface in the center, and a planar supporting base surface at the edge surrounding the light incident surface.

8. The lens according to claim 7, wherein the third light refractive surface is connected with the supporting base surface and has a profile inclined with respect to and extending towards, starting from the supporting base, the symmetrical axis of the lens so as to form an acute angle with the supporting base surface.

9. The lens according to claim 8, wherein the third light refractive surface extends towards the symmetrical axis of the lens, until a boundary of the second portion of the light.

10. The lens according to claim 1, wherein the first reflective surface (3) is a planar surface or an inclined surface.

11. The lens according to claim 1, wherein the first refractive surface, the second refractive surface and the third light refractive surface are respectively a spline curve in a cross section.

12. The lens according to claim 1, wherein the light incident surface is an arc surface in a cross section.

13. The lens according to claim 12, wherein the light incident surface is a semicircular surface in a cross section.

14. An omnidirectional illumination device, comprising:

a directional light source and a lens, the lens comprising:

a light incident surface, a first refractive surface, a first reflective surface, a second refractive surface, and a third refractive surface, each being rotationally symmetrical, respectively, wherein a first portion of light which passes through the light incident surface is refracted by the first refractive surface to produce first emergent light, a second portion of the light which passes through the light incident surface is reflected by the first reflective surface to the second refractive surface, and then is refracted by the second refractive surface to produce second emergent light, and a third portion of the light which passes through the light incident surface directly to the third light refractive surface is refracted by the third light refractive surface to produce third emergent light, the first emergent light, the second emergent light and the third emergent light jointly achieve omnidirectional illumination.

15. The omnidirectional illumination device according to claim 14, wherein the omnidirectional illumination device is a retrofit lamp.

16. A lens for omnidirectional illumination, the lens being rotationally symmetrical, the lens comprising:

a light incident surface, a first refractive surface, a first reflective surface, a second refractive surface and a third refractive surface, each being rotationally symmetrical, respectively, wherein a first portion of light which passes through the light incident surface is refracted by the first refractive surface to produce first emergent light, a second portion of the light which passes through the light incident surface is reflected by the first reflective surface to the second refractive surface, and then is refracted by the second refractive surface to produce second emergent light, and a third portion of the light which passes through the light incident surface is refracted by the third light refractive surface to produce third emergent light, the first emergent light, the second emergent light and the third emergent light jointly achieve omnidirectional illumination, wherein the lens comprises a bottom surface, a top surface, and side surface connecting the top surface with the bottom surface, the bottom surface is partially curved to form the light incident surface for a light source, the top surface comprises the first refractive surface and the first reflective surface, and the side surface comprises the second refractive surface and the third light refractive surface, wherein the top surface comprises the first refractive surface in the center, and the first reflective surface at the edge surrounding the first refractive surface, wherein the side surfaces comprise the second refractive surface connected with the first reflective surface, and the third refractive surface connected with the bottom surface, wherein the bottom surface comprises the concave light incident surface in the center, and a planar supporting base surface at the edge surrounding the light incident surface, and wherein the third light refractive surface is connected with the supporting base surface and has a profile inclined with respect to and extending towards, starting from the supporting base, the symmetrical axis of the lens so as to form an acute angle with the supporting base surface.

* * * * *